US005911204A

United States Patent [19]

Bahm et al.

[11] Patent Number: 5,911,204

[45] Date of Patent: Jun. 15, 1999

[54] IGNITION DISTRIBUTOR CAP WITH A SHIELDING HOOD AND SHIELDING HOOD, THEREFOR

[75] Inventors: Klaus Bahm, Kraichtal; Roland Michal, Pforzheim; Horst Behnke, Esslingen, all of Germany

[73] Assignees: Mercedes-Benz Aktiengesellshaft, Stuttgart; Doduco GmbH & Co., Dr. Eugen Dürrwächter, Pforzheim, both of Germany

[21] Appl. No.: 08/050,251

[22] Filed: Apr. 30, 1993

Related U.S. Application Data

[63] Continuation of application No. PCT/EP91/01996, Oct. 18, 1991.

[30] Foreign Application Priority Data

Oct. 18, 1990 [DE] Germany ..... 40 33 017
Jan. 22, 1991 [DE] Germany ..... 41 01 652

[51] Int. Cl.[6] ..... F02D 1/00; H01H 19/00

[52] U.S. Cl. ..... 123/146.5 A; 200/19 DC

[58] Field of Search ..... 123/146.5 A, 633; 200/19 DC, 19 DR

[56] References Cited

U.S. PATENT DOCUMENTS

| | | | |
|---|---|---|---|
| 1,987,755 | 1/1935 | Skaer et al. | 123/633 |
| 3,965,879 | 6/1976 | Fitzner | 123/633 |
| 4,078,534 | 3/1978 | Mayer | 123/633 |
| 4,575,593 | 3/1986 | Welker et al. | 200/19 DR |
| 4,577,610 | 3/1986 | Schmatz | 123/633 |
| 5,078,103 | 1/1992 | Bahm et al. | 123/146.5 A |
| 5,209,195 | 5/1993 | Nakagawa et al. | 123/146.5 A |

FOREIGN PATENT DOCUMENTS

| | | | |
|---|---|---|---|
| 846173 | 9/1939 | France | 123/146.5 |
| 2222882 | 10/1974 | France | 123/146.5 |
| 2314460 | 11/1981 | Germany | 123/146.5 |

*Primary Examiner*—Raymond A. Nelli
*Attorney, Agent, or Firm*—Dvorak and Traub

[57] ABSTRACT

An RFI shielding hood with an integral RFI filter arrangement for a distributor cap, so constructed as to provide strong attenuation in a predetermined broadcast and radiotelephone frequency range.

20 Claims, 5 Drawing Sheets

FIG. 7A
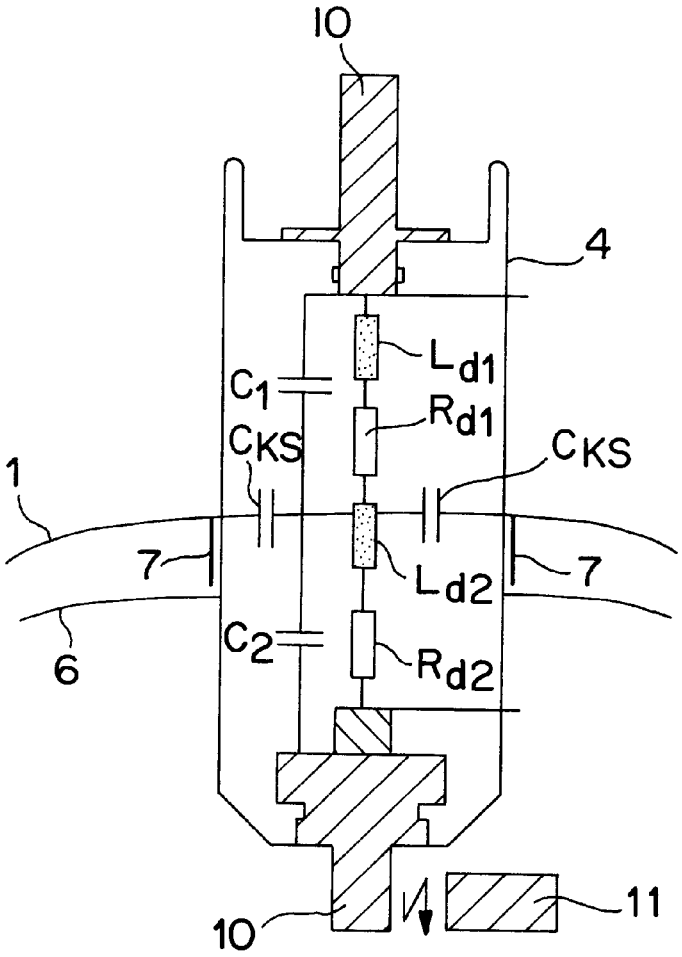
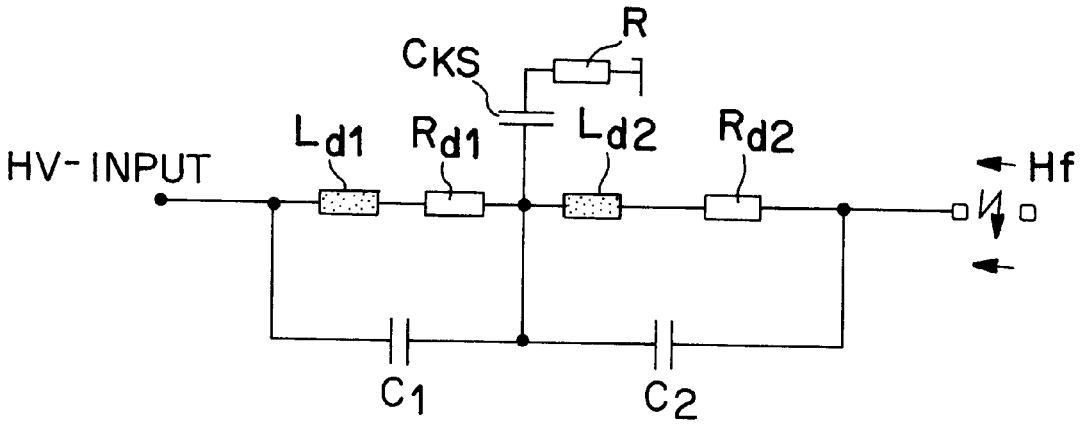
FIG. 7B

IGNITION DISTRIBUTOR CAP WITH A SHIELDING HOOD AND SHIELDING HOOD, THEREFOR

This is a continuation of application Ser. No. PCT/EP91/01996, filed on Oct. 18, 1991.

DESCRIPTION

1. Technical Field

This invention relates to a distributor cap of an ignition distributor for Otto engines, which cap comprises a shielding hood made of an electrically conductive material and having holes for receiving the domes of the distributor cap, wherein a highvoltage electrode extends through each of said domes, which are surrounded by sleeves of an electrically conductive material, which is connected to the electrically conductive material of the shielding hood.

2. Prior Art

Such a distributor cap is known from the German company publication of Robert Bosch GmwH entitled "Techniscne Unterrichtung, Funkenstörung", 1st edition of Sep. 30, 1978, on page 32, and from DE-C-23 14 460.

The known shielding hoods act like a Faraday cage. Unfortunately the Faraday cage has holes where the domes of the distributor cap extend through the shielding hood. For this reason the very high electromagnetic radiation which is generated in the ignition distributor and accompanies the sparks which jump between the stationary electrodes and the rotating rotor in the ignition distributor can partly escape through the holes in the shielding hood and interfere with the sound broadcasting reception. This is also true for the shielding hood known from DE-C-23 14 460. Whereas the latter shielding hood has extensions, which surround the domes of the distributor cap approximately to one-half of their height, the interfering radiation still escapes from the holes which are formed at said locations in the shielding hood.

SUMMARY OF THE INVENTION

It is an object of the present invention to improve in a simple manner the suppression of radio interference in such in a distributor cap that comprises a shielding hood.

The object is accomplished by a distributor cap having the features recited in claim 1. Desirable further features of the invention are subject matters of the dependent claims.

Because the domes are surrounded by sleeves of an electrically conductive material, which is connected to the electrically conductive material of the shielding hood and together with the electrode in the respective dome constitutes an approximately cylindrical capacitor, the capacitance is so selected in accordance with the invention that in combination with the high-voltage electrode an electric filter is provided, which at the frequencies of a predetermined range for radio reception effects a strongly pronounced attenuation so that the interfering electromagnetic radiation which is emitted is strongly reduced. The resulting filter comprises parts of a low-pass filter but the large number of the storing elements (capacitances and inductances) which are involved provide also a filter of higher order, which has a plurality of resonance points. As a result, the electromagnetic radiation which is emitted is effectively damped. First experiments have shown that the design in accordance with the invention can reduce in the very high frequency sound broadcasting range (87 to 105 MHz), which is particularly susceptible to interference, the emitted radiation under the operating conditions of a vehicle by 30 dB compared to the use of a shielding hood of the prior art. From that comparison it is apparent that the success of the invention cannot be explained by the fact that the Faraday cage constituted by the shielding hood has a much higher density. Contrary to the prior art the invention is not restricted to the fact that the shielding hood is used as a Faraday cage but the latter is supplemented by filters, which strongly damp in a controlled manner the interfering radiofrequency radiation in the receiving range which is susceptible to interference.

The filter is preferably so matched that the filter has a resonance point (peak attenuation) in the reception frequency range in which interference is to be suppressed. Matching is effected by a change of the length and/or arrangement of the extensions provided on the associated dome and may experimentally be determined and optimized. That reception frequency range which is of interest and in which interference is to be suppressed will generally be the very high frequency sound broadcasting range. But the filter may also be so matched that a resonance point is achieved in a different frequency range in which interference is to be suppressed, particularly in the frequency range for radiotelephone communication (450 MHz band).

The electrically conductive material of the sleeves which surround the domes is preferably spaced from the free end of the dome so that the required high voltage dielectric strength of the distributor cap is ensured. The high voltage dielectric strength will be the higher the larger is the distance from the electrically conductive material to the free end of the domes, For this reason the sleeves made of the electrically conductive material are preferably provided at the bottom end of the domes so as to adjoin their bases. But the length of the sleeves made of electrically conductive material should not be too small because the larger the length the higher will be the resulting capacitance and the more effective will be the filter. The sleeve made of the electrically conductive material has preferably a length between 5 and 30 mm, most preferably 7 to 12 mm, because in that case the capacitance will be much higher than that which can be achieved with shielding hoods of the prior art and, on the other hand, a sufficient high voltage dielectric strength of the distributor cap will be ensured.

To achieve a high capacitance, the electrically conductive material desirably lies directly on the associated dome whereas air gaps are avoided. In that case the distance to the capacitor electrodes will be minimized and the dielectric interposed between them will have the highest dielectric constant. This is different in the prior art according to DE-C-23 14 460, where an air gap between the domes and the surrounding extensions of the shielding hood is intentionally provided.

The sleeves made of the electrically conductive material can be provided in that the domes are metallized on their outside on a corresponding annular area. In that case any air gap between the dome and its metallization will be avoided. Metallizing may be effected by an adhesive bonding of a metal foil. It will be more desirable to metallize the domes in the corresponding area of their outside surface by an electroless deposition of metal or to apply a conductive adhesive (an adhesive which contains electrically conductive pigment). A contact between the shielding hood and the metallized surface portions of the domes is established in that the rim of the holes of the shielding hood engages the outside surface of the domes under a certain initial stress. The required ground contact with the engine block is also established via the shielding hood.

But it will be most simple to leave the distributor cap unchanged and so to design the shielding hood that the holes through which the domes extend are defined by sleevelike extensions, which surround the domes as closely as possible and preferably contact the domes over the full length of the extensions.

The extensions may be formed on the shielding hood during the shaping thereof as integral parts in one and the same operation, particularly if the shielding hood is made of plastic, as is known per se. An electrical conductivity can be imparted to the hood in that the hood is metallized on its surface and more preferably by the use of a plastic which has been rendered electrically conductive by an electrically conductive additive, such as carbon black or a metal powder.

It will be particularly desirable to use a shielding hood which is known per se and which has holes, through which the domes can extend, but has no sleevelike extension, and to supplement said shielding hood by a separate shaped member, which is made of sheet metal and has sleevelike extensions, through which the domes can extend. That shaped member may be loosely gripped between the distributor cap and the shielding hood so that the gripping establishes a contact between the shaped member and the shielding hood and the domes. An advantage resides in that the distributor cap and the shielding hood may be left unchanged relative to the prior art and that only a simple, thin sheet metal member is added; that member can be formed by deep-drawing. Alternatively, such a sheet metal member may fixedly be connected to the shielding hood, e.g. by riveting or preferably by adhesive bonding by means of a conductive adhesive. Just as any electrically conductive extensions of the shielding hood, the extensions of the sheet metal member should contact the domes as tightly as possible, preferably at the lower portion of the domes, approximately on the level of the middle of the high-voltage electrode, so that the filter substantially constitutes a T-network. In case of such extensions disposed on a low level and in close contact a sufficiently large air space is desired between the distributor cap and the shielding hood; such air space may serve as heat insulation and permits moisture to condense therein. This can be accomplished in that the extensions preferably do not rise from the shielding hood (in that case the shielding hood would have to contact the distributor cap more closely) but depend into the shielding hood from above. Alternatively, transitional forms may be adopted, in which the extensions partly rise and partly depend.

BRIEF DESCRIPTION OF THE FIGURES

FIGS. 7A & 7B are an equivalent circuit diagrams representing a shielded dome.

In both illustrative embodiments, like or corresponding parts are designated with the same reference numerals.

Figure 1:
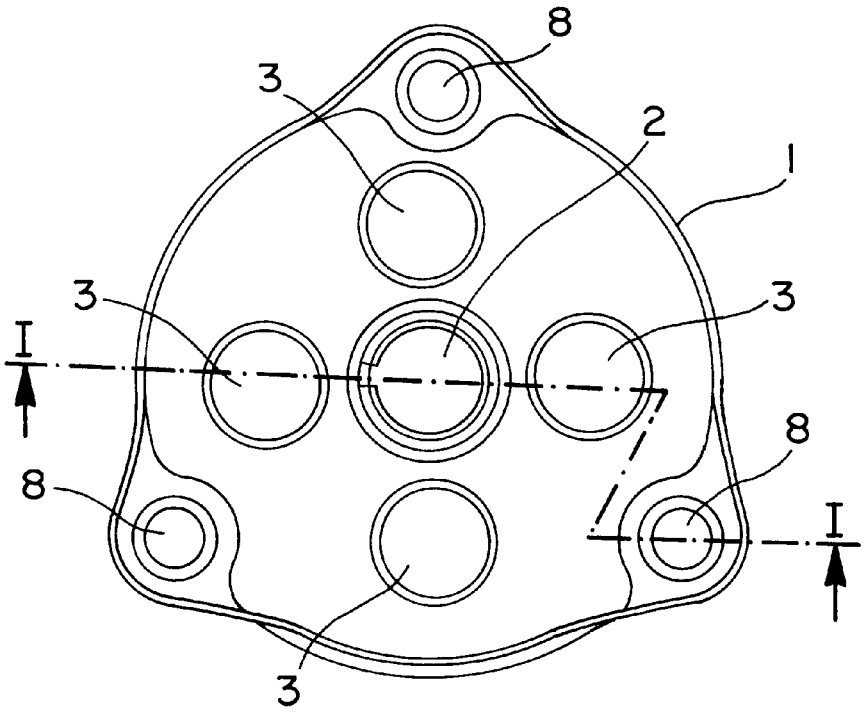
FIG. 1 is a top plan view showing a shielding hood in accordance with the invention.
Figure 2:
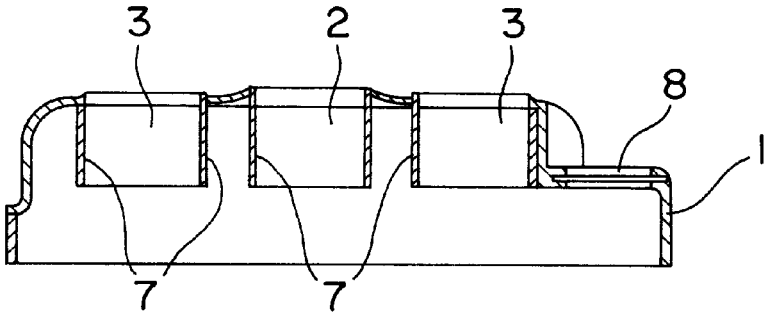
FIG. 2 is a longitudinal sectional view taken on the section line I—I in FIG. 1 and showing the shielding hood.
Figure 3:
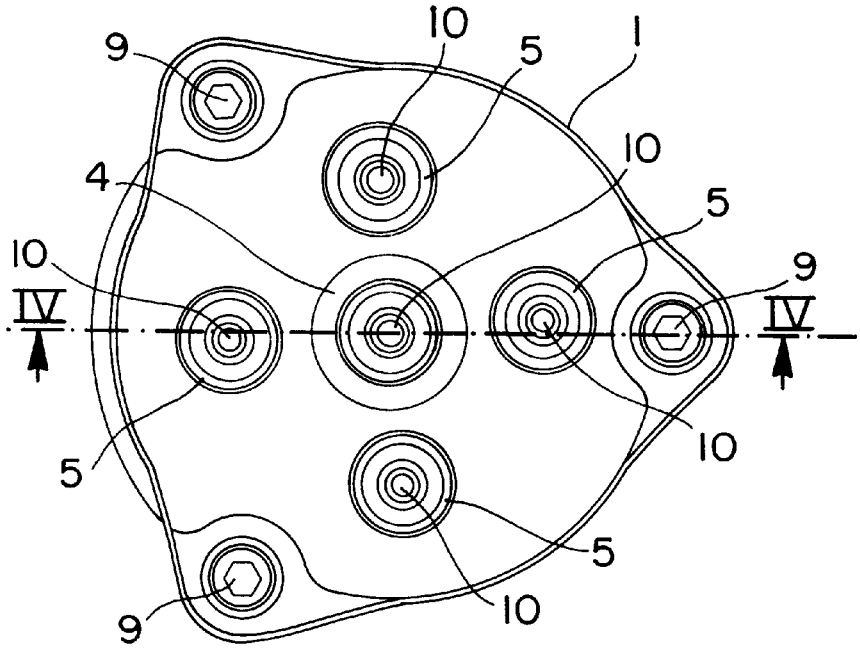
FIG. 3 is a top plan view showing the shielding hood of FIG. 1 mounted on a distributor cap.
Figure 4:
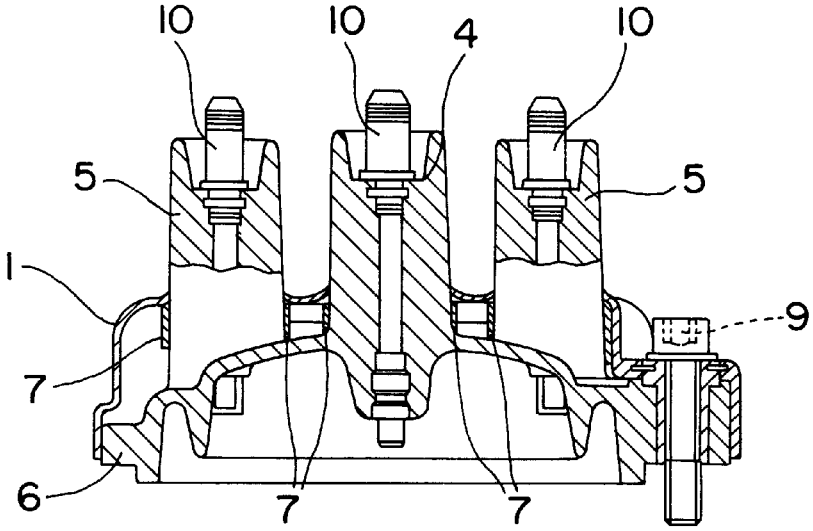
FIG. 4 is a longitudinal sectional view taken on section lines IV—IV and showing the assembly of FIG. 3.

The shielding hood 1 has a central hole 2 for receiving the central dome 4 of a distributor cap 6 and also has holes 3 which are spaced around the central hole and serve to receive the remaining four domes 5 of the distributor cap. The domes 5 are equal in number to the cylinders of the Otto engine which are to be supplied via the ignition distributor.

An extension 7 extends from the rim of each of said holes into the interior of the shielding hood 1. In this illustrative embodiment the extensions are cylindrical, but they may alternatively be conical to match the conventional conical shape of the domes 4 and 5. The latter shape is preferred because in that case the capacitor formed between the extension 7 and the electrode 10 will have a higher capacitance and will more strongly damp the interfering radiation. Conical extensions may perfectly tightly contact the domes.

Three holes 8 provided at the rim of the shielding hood 1 serve to secure the shielding hood to the base part of a housing for the ignition distributor.

The fixation is preferably effected by means of screws 9, which also establish the electrical connection between the shielding hood 1 and the metallic base part of the housing for the ignition distributor and further to the engine block.

If the shielding hood 1 is slidably fitted on the distributor cap 6, the domes 4 and 5 will protrude from the holes 3 and the cylindrical extensions 7 engage the outside surface of the bottom portion of the domes 4 and 5 and together with the high-voltage electrodes 10 embedded therein constitute a capacitor, the capacitance of which in combination with the interference-suppressing resistance in the dome, with the predetermined inductances associated with the electrode 10 and with the resistance of the shielding hood constitutes an electric filter.

Figure 6:
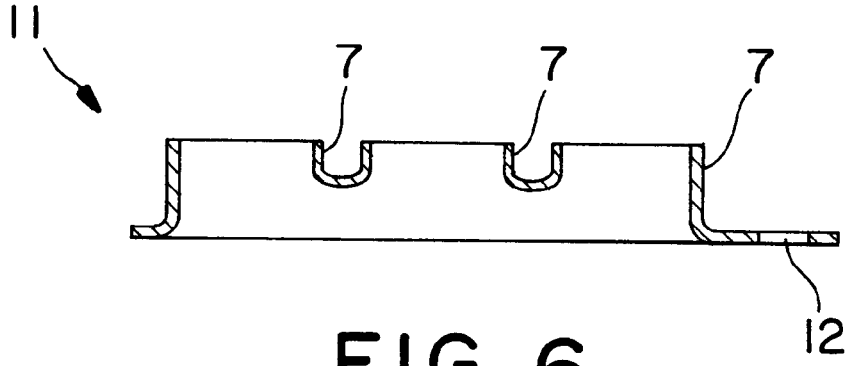
FIG. 6 is a longitudinal sectional view like FIG. 5 and shows the shaped member of FIG. 5.
Figure 5:
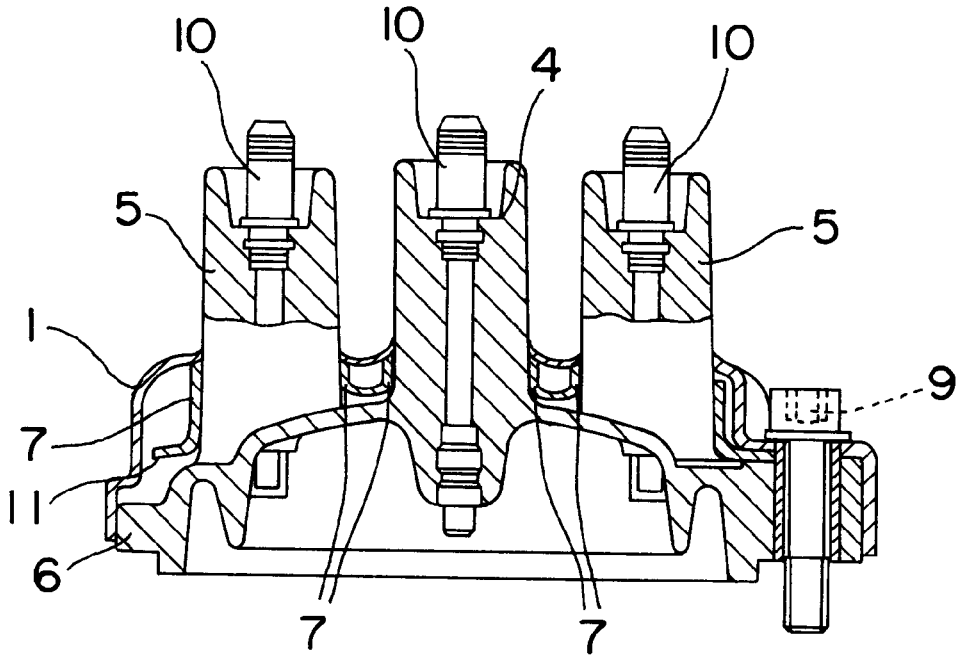
FIG. 5 is a view that is a similar to FIG. 4 and shows a second illustrative embodiment of the invention with a shaped member that is made of sheet metal and disposed between the shielding hood and the distributor cap.
Figure 8:
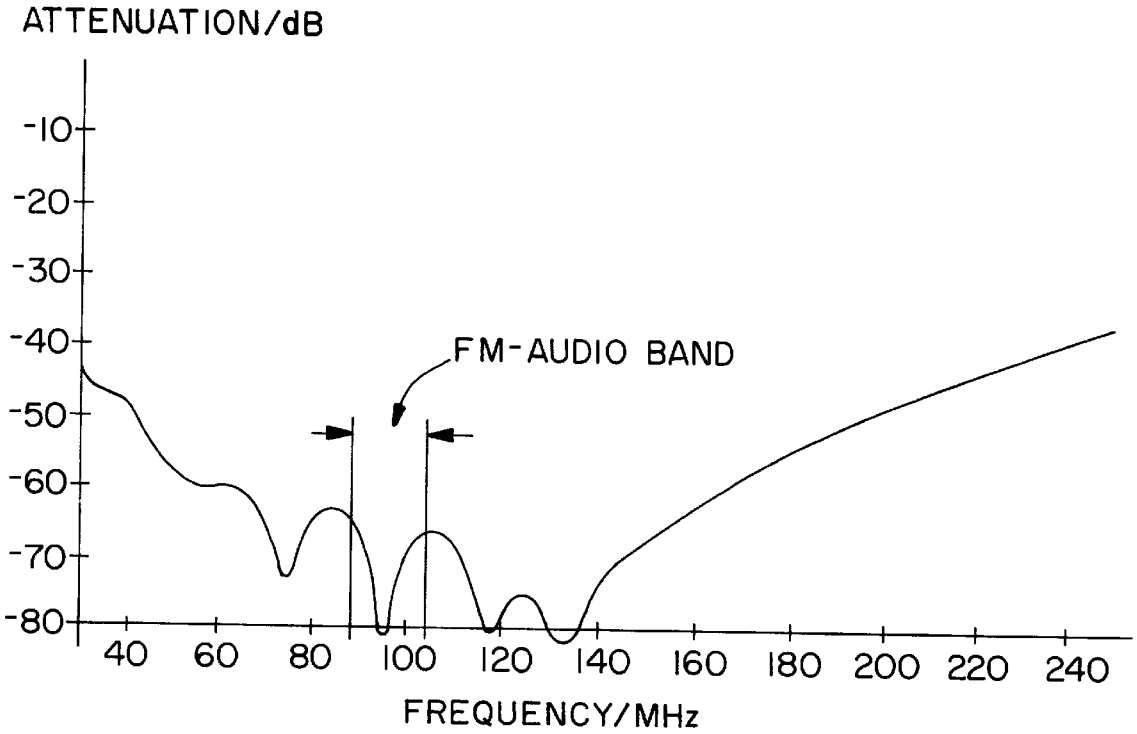
FIG. 8 is a filter diagram.

The illustrative embodiment shown in FIGS. 5 and 6 comprises a shaped member 11 that is made of sheet metal and is gripped between the distributor cap 6 and the shielding hood 1 and has extensions 7, which contact the domes 4, 5 and establish a contact with the shielding hood 1. Holes 11 are provided at the rim of the shaped member 11 at locations which register with the locations of the holes 8 of the shielding hood—see FIG. 1—so that the shielding hood 1 and the shaped member 11 can be connected to the distributor cap 6 by common screws 9.

FIG. 7*a* is an equivalent radiofrequency circuit diagram of a dome, such as the central dome 4, which rises from a distributor cap through a shielding hood 1, which has a cylindrical extension 7, which depends to-ward the distributor cap 6 and constitutes the outer electrode of a cylindrical capacitor having the capacitance $C_{KS}$. The inner electrode of that capacitor is constituted by the high-voltage electrode 10. If the extension 7 is arranged as selected, the capacitance $C_{KS}$ will be coupled to the high-voltage electrode 10 approximately in the middle thereof so that a T-shaped filter network is obtained, which in its two branches includes inductances $L_{d1}$ and $L_{d2}$, which are associated with the high-voltage electrode 10, and resistance portions $R_{d1}$ and $R_{d2}$ which are bridged by respective capacitances $C_1$ and $C_2$, which are due to the design of the central dome 4. The T-network contains in its base the capacitance $C_{KS}$ and a resistance R, which substantially constitutes the resistance of the shielding hood 1, which is connected to ground (engine block).

The resulting filter damps radiofrequency portions of the currents which are generated by the sparks jumping from the high-voltage electrode 10 to the passing electrode 11 of the rotor of the distributor.

FIG. 7*b* depicts the parameters of a circuit diagram. Typical parameters for the equivalent circuit diagram are as follows:

$L_{d1}$=34,5 uH microhenries $L_{d2}$=34,5 uH microhenries $R_{d1}$=0,5 kiloohms $R_{d2}$=0,5 kiloohms $C_1$=0,08 picofarads $C_2$=0,08 picofarads $C_{KS}$=1,7 picofarads R=40 ohms $L_{d1}$, $L_{d2}$; $R_{d2}$, $R_{d2}$, $C_1$ and $C_2$ are determined by the design and position of the extension 7. R is determined by the nature and design of the shielding hood. $C_{KS}$ can be adjusted by a selection of a suitable length for the extension 7.

The filter reduces mainly the interfering radiation in the very high frequency sound broadcasting range (87 to 105 MHz) because the extension has been provided in an experimentally determined, suitable design and arrangement so that the filter has such parameters that it has a resonance point (peak attenuation) in the middle of the very high frequency sound broadcasting range. If a preferential damping of another frequency range is desired, e.g., the frequency range of the C network for radiotelephone communication, the extension 7 can properly be matched so that the filter has a resonance point (peak attenuation) in that frequency range.

We claim:

1. A distributor cap of an ignition distributor for Otto engines, comprising a shielding hood, which serves to suppress radio interference and is made of an electrically conductive material and has holes for receiving the domes of the distributor cap, wherein a high-voltage electrode extends through each of said domes, which are surrounded by sleeves made of an electrically conductive material, which is connected to the electrically conductive material of the shielding hood, characterized in that the capacitance of the capacitor, which is constituted by the sleeve of electrically conductive material that surrounds the associated dome, and by the high-voltage electrode that extends through the dome, an interference suppressing resistance in the dome and the inductances associated with the high voltage electrode are so matched, the capacitance being determined by the arrangement of the electrically conductive material on the associated dome, that in combination with the high-voltage electrode an electric filter is provided, which effects a strongly pronounced attenuation at the frequencies of a predetermined radio reception range, namely, of the very high frequency range, particularly of the very high frequency sound broadcasting range and the radiotelephone ranges.

2. A distributor cap according to claim 1, characterized in that the arrangement of the electrically conductive material on the associated dome is so selected that the filter has a peak attenuation in the predetermined radio reception range.

3. A distributor cap according to claim 1, characterized in that the domes are surrounded by the electrically conductive material only at a distance from their free end.

4. A distributor cap according to claim 1, characterized in that the sleeve made of the electrically conductive material has a length between 7 and 12 mm.

5. A distributor cap according to claim 1, characterized in that the domes are metallized on the outside.

6. A distributor cap according to any of claim 1, characterized in that a shaped member (11) made of sheet metal and provided with sleevelike extensions (7) is provided between the distributor cap (6) and the shielding hood (1).

7. A distributor cap according to claim 6, characterized in that the shaped member (11) is loosely inserted.

8. A distributor cap according to claim 6, characterized in that the shaped member (11) is firmly connected to the shielding hood (1) and in particular is adhesively bonded to it by an electrically conductive adhesive, characterized in that the sleevelike extensions (7) closely surround the domes (4, 5).

9. A distributor cap according to claim 8, characterized in that the sleevelike extensions (7) directly contact the domes (4, 5).

10. A shielding hood (1), which is made of electrically conductive material and intended to be used in a distributor cap (6) of an ignition distributor for Otto engines, which hood has holes (2, 3) for receiving the domes (4, 5) of the distributor cap and is provided with sleevelike extensions (7), which are made of an electrically conductive material and define the holes (2, 3), characterized in that the extensions (7) extend into the interior of the shielding hood (1).

11. A distributor cap according to claim 2, characterized in that the domes are surrounded by the electrically conductive material only at a distance from their free end.

12. A distributor cap according to claim 3, characterized in that the sleeve made of the electrically conductive material has a length between 7 and 12 mm.

13. A distributor cap according to claim 12, characterized in that the sleeve made of the electrically conductive material has a length between 7 and 12 mm.

14. A distributor cap according to claim 2, characterized in that the sleeve made of the electrically conductive material has a length between 7 and 12 mm.

15. A distributor cap according to claim 2, characterized in that the domes are metallized on the outside.

16. A distributor cap according to claim 3, characterized in that the domes are metallized on the outside.

17. A distributor cap according to claim 4, characterized in that the domes are metallized on the outside.

18. A distributor cap according to claim 2, characterized in that a shaped member made of sheet metal and provided with sleevelike extensions is provided between the distributor cap and the shielding hood.

19. A distributor cap according to claim 3, characterized in that a shaped member made of sheet metal and provided with sleevelike extensions is provided between the distributor cap and the shielding hood.

20. A distributor cap according to claim 4, characterized in that a shaped member made of sheet metal and provided with sleevelike extensions is provided between the distributor cap and the shielding hood.

* * * * *